United States Patent [19]

Fischer

[11] Patent Number: 4,763,428

[45] Date of Patent: Aug. 16, 1988

[54] LOCKABLE SECURITY PICTURE FRAME

[76] Inventor: Joey G. Fischer, 5747 Parkmor Rd., Calabasas, Calif. 91302

[21] Appl. No.: 795,450

[22] Filed: Nov. 6, 1985

[51] Int. Cl.[4] ..... A47G 1/06

[52] U.S. Cl. ..... 40/152; 40/611

[58] Field of Search ..... 40/611, 152, 202, 16; 70/57, 367, 369; 248/553

[56] References Cited

U.S. PATENT DOCUMENTS

| | | | |
|---|---|---|---|
| 709,466 | 9/1902 | Butt | 40/611 |
| 1,821,053 | 9/1931 | Dietz et al. | 40/202 |
| 2,206,281 | 7/1940 | Goeller | 40/611 |
| 3,713,311 | 1/1973 | Oliver et al. | 70/369 |
| 4,017,989 | 4/1977 | Murray | 40/152 |
| 4,041,630 | 8/1977 | Holbrook | 40/152.1 |
| 4,463,924 | 8/1984 | Conti | 248/553 |

*Primary Examiner*—Gene Mancene
*Assistant Examiner*—Cary E. Stone
*Attorney, Agent, or Firm*—Drucker & Sommers

[57] ABSTRACT

A lockable security picture frame, for enabling secure mounting of a picture depicting a therapeutic subject therein, adapted to enable such picture to be slipped thereinto and locked therein, so as to prevent removal thereof. The device includes a frame including a plurality of sides joined together, with a picture-receiving slot formed in one side of the frame through which the picture may be slipped into the frame. It further includes a lock, adapted to be mounted in the frame at a location in or contiguous with the picture-receiving slot, which includes a portion thereof which extends into such slot so as to block removal of the picture.

2 Claims, 1 Drawing Sheet

LOCKABLE SECURITY PICTURE FRAME

BACKGROUND OF THE INVENTION

The invention relates generally to picture frames, and relates specifically to a lockable security picture frame, adapted to enable a selected picture depicting a therapeutic subject to be slipped thereinto and locked therein, and to be removable therefrom upon unlocking thereof by an authorized person.

The prior art discloses picture frames in which one of the sides thereof is hingedly or detachable connected to the other sides, to enable insertion or removal of a picture therefrom, as in U.S. Pat. Nos. 2,839,857, 2,954,630, 3,514,886, and 3,883,974.

However, such devices do not provide a lockable security picture frame, in which all of the sides thereof are securely united and joined, and are not hingedly or detachably connected, while enabling a picture to be slipped thereinto and locked therein. Further, such prior art does not disclose the use of pictures having therapeutic value, in that the subjects depicted and manner of depicting such subjects assists in reducing stress and anxiety in a person viewing same, adapted to be mounted in the lockable frame to prevent theft thereof.

Still further, such prior art does not disclose the use of a collection of such therapeutic pictures, to provide a selection from which a person may choose a desired picture for mounting in the security frame and placement thereof in an area in which such person will be staying, to return a measure of control over the surroundings to such person. Still further, such prior art does not disclose the use of such lockable security frame with a therapeutic picture mounted therein as part of an identification system which includes a smaller duplicate of such picture adapted to be carried by or on the person of the user, where such person suffers from a cognitive disorder impeding such person's ability to locate his or her room in a multi-room facility.

SUMMARY OF THE INVENTION

The invention is adapted to overcome the above problems, as well as others, associated with the prior art.

The device of the invention provides a lockable security picture frame, wherein all of the sides of which such frame is comprised are united and joined securely together, and are not detachable or pivotally hinged, while still enabling a picture to be slipped into such frame and securely locked therein.

Such device further provides pictures having therapeutic value to a person viewing same, as for a patient in a hospital, by virtue of the subject matter depicted and manner of depiction thereof, adapted to be securely mounted in the lockable frame to prevent removal thereof. Such therapeutic pictures may, for example, comprise large rigidly-mounted photographs of scenes of nature, which are particularly well suited to visually involve, distract, and occupy the attention of the viewer. For patients in hospital rooms, such pictures help to reduce stress and anxiety, assisting in enabling faster healing and rehabilitation, the use of less medication, and a more positive attitude towards fighting the illness and towards the people who come into contact with such patient.

The device still further provides a collection of such therapeutic pictures, securely lockable in the lockable security picture frame. Such collection enables a person, such as a hospital patient, to choose the picture desired by such person from among those in the collection for use in the room where he or she will stay, which returns to such person a measure of control over the surroundings, increasing the feeling of self-worth and assisting in generating a positive attitude.

The device still further is part of a system which provides identification for a patient's room more readily recognizable by the patient, and readily recognized by persons assisting such patient, where a patient suffers from a cognitive disorder such as Alzheimer's disease but is not confined to his or her room.

The device includes a lockable security picture frame including a plurality of sides all securely joined together, with a slot in one of such sides adapted to enable the selected therapeutic picture to be slipped therethrough into and out of the frame. It further includes a lock, adapted to be mounted in the frame so as to block at least a portion of the slot, to prevent removal of the picture therefrom, while enabling unlocking of the lock by authorized persons for removal and replacement of the picture.

The system which includes the lockable security picture frame and selected therapeutic picture, used for patient room identification purposes, further includes a small duplicate of the same picture, adapted to be carried by or on the person of the patient, to assist the patient or persons assisting the patient in locating the patient's room by matching the small picture with the large picture mounted in the lockable security picture frame in the patient's room.

DETAILED DESCRIPTION OF THE DRAWINGS

Figures 1, 2, 3, 4, 5:
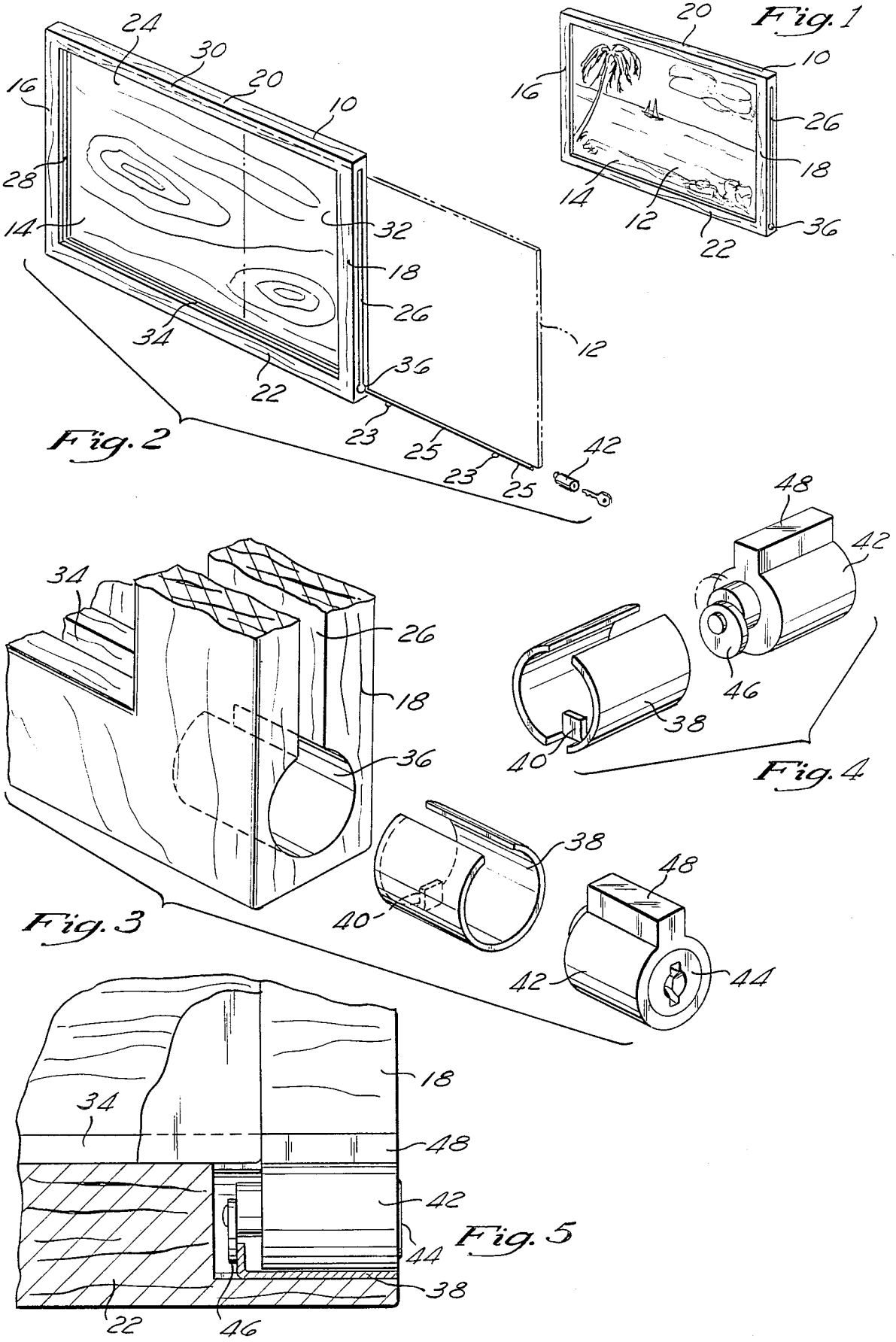
FIG. 1 is a front elevational view of a lockable security frame pursuant to the invention.
FIG. 2 is a side elevational view thereof taken along lines 2—2 of FIG. 1.
FIG. 3 is a side fragmentary view of the portion of the picture frame with the picture-receiving slot therein and with the lock-receiving sleeve mounted therein.
FIG. 4 is a perspective upside down view of a lock for the frame.
FIG. 5 is a side fragmentary view of the portion of the picture frame with the picture-receiving slot therein and with the lock mounted therein.

The device of the invention, as shown in FIGS. 1–5 and as described herein, comprises, for example, a lockable frame 10 for securing a selected therapeutic picture 12 therein. It is adapted to enable picture 12 to be slipped into, removed from, and locked and unlocked therein by persons authorized to have access thereto, while preventing removal thereof by persons not so authorized.

Lockable frame 10, in the preferred embodiment thereof, is relatively large and generally rectangular in shape, defining a generally rectangular picture-viewing opening 14 in the front portion thereof. Lockable frame 10 includes first and second side members 16 and 18, of generally equal length, width, and thickness. It further includes top and bottom members 20 and 22, generally longer than sides 16 and 18, and generally equal in length, width, and thickness. Frame 10 still further includes a backing member 24. First and second side members 16 and 18, top and bottom members 20 and 22, and backing member 24, are joined together to form lockable frame 10.

Picture 12 is preferably relatively large and generally rectangular in shape. It preferably comprises a rididly-mounted photograph of a natural scene, adapted to visually aid in relieving anxiety and stress. It is further preferably selectable from a collection of such scenes to provide the person making the selection with a measure of control over his or her surroundings.

In lockable frame 10, second side member 16 has an elongated relatively-narrow generally rectangular-shaped slot 26 extending therethrough, generally from the juncture of second side member 18 with top member 20, to the juncture of second side member 18 with bottom member 22. Slot 26 is adapted to enable picture 12 to be slipped therethrough into and out of lockable frame 10.

Lockable frame side member 16 and 18, and top and bottom members 20 and 22, each include a groove 28, 30, 32 and 34, formed along the edge thereof facing picture-viewing opening 14. Grooves 28, 30, 32 and 34 open into picture-viewing opening 14, and are aligned with each other and with slot 26, to enable picture 12 to be slipped into and out of lockable frame 10, and to be supportably mounted at the peripheral edges upon being slipped thereinto.

A generally cylindrical- shaped relatively-small hole 36 is formed in second side member 18 of lockable frame 10, in the end portion thereof adjacent bottom member 22, contiguous with and opening into slot 26. A sleeve 38 is adapted to be fitted into and mounted in hole 36 so as to be secured to lockable frame 10. It includes a tab 40 projecting into the hollow portion thereof proximate the closed end.

A lock 42, generally cylindrical-shaped and relatively-small, is adapted to be mounted in sleeve 38 in second side member 18 of lockable frame 10. Lock 42 includes a key-actuatable rotatable cylinder 44 therein. It further includes, at its end, a rotatable disk 46, connected to the lock cylinder 44 so as to rotate about a point offset from the center thereof, engagable with sleeve tab 40 for engaging and disengaging lock 42 relative to sleeve 38 and lockable frame 10. A bar portion 48 extends from and along one side portion of cylindrical lock 42, adapted to project into, and block, an adjacent portion of slot 26 upon insertion thereof into slot 26.

Lockable frame 10 further includes a mechanism for enabling picture 12 to slide out of frame 10 automatically upon unlocking and removing lock 40 from frame 10. Such mechanism provides a support for the bottom edge of picture 12, is positioned in bottom groove 30, and is tilted slightly in the direction of slot 22. It includes (not shown) a plurality of relatively-small rollers 23 adapted to fit in bottom groove 30, and a wire 25, interconnecting the rollers 23, and adapted to support and guide picture 12 in an inclined direction towards slot 22.

Lockable frame 10, in a further embodiment of the invention, is a part of a system for assisting a patient having a cognitive disorder, such as Alzheimer's disease, in locating such patient's room in a multi-room care facility such as a hospital.

Such system includes a relatively large picture, preferably of a natural scene, selectable by the patient upon entry into the facility from a collection of such pictures. It further includes a lockable frame, as frame 10, adapted to enable the selected picture to be locked therein to prevent removal thereof, or to be unlocked to enable removal and replacement of such picture as desired. The relatively large picture in such lockable frame is adapted to be mounted in the patient's room.

The system further includes a second smaller version of the same selected picture, adapted to be mounted in a lockable frame on the wall outside the patient's room or on the door of the patient's room. The system still further includes a third smaller version of the same selected picture, adapted to be carried by or on the person of the patient.

In use, for example, a person in an anxiety-generating environment, such as a patient in a hospital room, may select a picture 12, such as a rigidly-mounted photograph of a natural scene, adapted to enhance such person's environment, to return to such person a measure of control over the surroundings, and to improve such person's mental attitude in such surroundings.

Picture 12 may then be slipped into frame 10, sideways through slot 26 in frame second side member 18, and along grooves 28, 30, 32 and 34 which support the edges thereof, until picture 12 is securely positioned in lockable frame 10.

Lock 42 may then be inserted in sleeve 38 mounted in lockable frame 10, with bar portion 46 thereof sliding through the adjacent end portion of slot 26 so as to block same. Lock 40 may then be locked in position by rotating the cylinder 42 therefor, thereby rotating rotatable disk 44 into engagement with sleeve tab 36 in lockable frame 10.

In such position, picture 12 is securely locked in frame 10, preventing unauthorized persons from removing same. At the same time, picture 12 enhances the surroundings and attitude of persons who view same, and if selected by the person who is staying in such facility, returns a measure of control over the surroundings to such person.

The bar portion 48 of lock 42, upon insertion thereof into a portion of slot 26 of lockable frame 10, and upon locking of lock 42 in frame 10, through engagement of rotatable disk 46 with tab 40, provides security for picture 12, preventing removal thereof from frame 10. Since picture 12 is a relatively large item of substantial value to the facility which purchased it, and in view of the opportunities for removal of items of value in large accessible facilities such as hospitals or office buildings, lockable frame 10 provides an effective and efficient way in which to secure and mount picture 12.

The lockable security picture frame 10, adapted to be mounted in the room, is adapted to be used in conjunction with the different-sized prints or versions of the same picture, including one adapted to be carried by or on the patient, to enable matching, by the patient or by a person assisting the patient, of the patient with the patient's room. Since persons suffering from cognitive disorders, such as Alzheimer's disease, not confined to their rooms, may leave such rooms, may become disoriented and have trouble remembering their room number, and may wander into different rooms, the use of matching pictures enables ready identification and assistance in locating the proper room.

The lockable security picture frame 10 may be used with a therapeutic picture mounted therein in other stressful environments apart from hospital rooms, as in computer workstation rooms, telephone operator facilities, or other appropriate environments.

A preferred embodiment of the invention has been set forth above, for the purpose of explaining the invention.

However, it is to be understood that variations may be made in such embodiment, which variations are nevertheless within the scope and spirit of the invention as set forth in the claims herein.

I claim:

1. A lockable frame for mounting a picture therein, which picture is adapted to be slipped into the frame, which frame enables insertion, removal, locking, and unlocking of the selected picture therein, comprising:

(a) an integral frame, comprised of a plurality of sides, all of which are joined together, having a slot formed in one side thereof adapted to enable the selected picture to be slipped therethrough into and out of the frame and further including a hole, formed in the frame at a location in or contiguous with, and opening into, the slot;

(b) means for blocking at least a portion of the picture-receiving slot in the frame, adapted to be mounted in the frame comprising a lock, for enabling the selected picture to be securely mounted in the frame so as to prevent unauthorized removal thereof, adapted to be mounted in the hole in the frame, to be lockable to and unlockable from the frame, and to block a portion of the slot to prevent removal of the picture; and (c) slidable enabling means for enabling the picture to be slidable automatically out of the frame upon unlocking and removal of the lock from the frame.

2. A lockable frame as in claim 1, in which the frame includes a bottom member which has an interior groove therein aligned with the slot and adapted to enable the bottom edge of the picture to be fitted and supported therein, and in which the said slidable enabling means is located.

* * * * *